US006032510A

United States Patent [19]

Smith et al.

[11] Patent Number: 6,032,510

[45] Date of Patent: Mar. 7, 2000

[54] BLIND RIVET SETTING TOOL

[75] Inventors: Daniel Robin Smith, Castle Bromwich; Stephen Morris, Great Barr; John Davies, Handsworth, all of United Kingdom

[73] Assignee: Emhart Inc., Newark, Del.

[21] Appl. No.: 09/203,273

[22] Filed: Dec. 1, 1998

[30] Foreign Application Priority Data

Dec. 6, 1997 [GB] United Kingdom ..... 9725793

[51] Int. Cl.[7] ..... B21J 15/10; B21B 31/00

[52] U.S. Cl. ..... 72/391.4; 29/243.521; 29/243.527

[58] Field of Search ..... 29/243.521, 243.526, 29/243.527, 243.518; 72/391.4, 391.2

[56] References Cited

U.S. PATENT DOCUMENTS 4,653,309 3/1987 Hendricks et al. ..... 72/391.2

5,295,290 3/1994 Johnston ..... 29/243.527

*Primary Examiner*—David Jones

*Attorney, Agent, or Firm*—Edward D. Murphy

[57] ABSTRACT

A blind rivet setting tool (10) includes a front end (2) having an outer support barrel (4), an inner pulling mandrel (6) and a rivet flange contacting face (8). A portion of the outer support barrel (4) and a portion of the inner mandrel (6) are cut away along the length of the tool (10) extending from the rivet flange contacting face (8), to provide a cut-away face (12), a slot (14) extending from the rivet flange contacting face (8) of the outer support barrel (4) and comprising a first section (16) located in the outer support barrel (4) and sized to accept the mandrel of a blind rivet, a second section (18) located in the pulling mandrel (6) and sized to accept the mandrel of a blind rivet and a third section (34) located in the pulling mandrel (6) and sized to accept the pulling head of the mandrel of the blind rivet is formed along the length of the barrel (4) and pulling mandrel (6), open to the cut-away face (12) of the barrel (4) and pulling mandrel (6) and retaining means (20) is provided to retain a rivet in the slot (14).

2 Claims, 2 Drawing Sheets

BLIND RIVET SETTING TOOL

BACKGROUND OF THE INVENTION

The present invention relates to a blind rivet setting tool with improved rivet pulling means, for use in locations where access is a problem.

While such tools are well adapted for setting rivets in locations where access to the holes in the components to be secured is not restricted, a problem arises where access is restricted, for example, if a face of the component is in close proximity to the holes in the workpiece.

In such circumstances, the problem is usually overcome by providing the blind rivet with a mandrel that is much longer than would otherwise be necessary, so that the jaws of the setting tool can grip the mandrel at a position that is beyond the outer face of the component, and the flange of the rivet is supported by a nosepiece which is longer than normal. The rivet has a mandrel which is correspondingly longer than normal in order to engage the gripping jaws. It is, however, undesirable to use mandrels which are longer than otherwise necessary because of the additional costs of raw materials and manufacturing.

SUMMARY OF THE INVENTION

It is an object of the present invention to provide a blind rivet setting tool in which the above disadvantages are reduced or substantially obviated.

The present invention provides a blind rivet setting tool which comprises a front end comprising an outer support barrel, an inner pulling mandrel and a rivet flange contacting face, characterized in that a portion of the outer support barrel and a portion of the inner mandrel are cut away along the length of the tool extending from the rivet flange contacting face to provide a cut-away face, a slot extending from the rivet flange contacting face of the outer support barrel and comprising a first section located in the outer support barrel and sized to accept the mandrel of a blind rivet, a second section located in the pulling mandrel and sized to accept the mandrel of a blind rivet and a third section located in the pulling mandrel and sized to accept the pulling head of the mandrel of the blind rivet, is formed along the length of the barrel and the pulling mandrel, open to the cut-away face of the barrel and the pulling mandrel, and retaining means is provided to retain a rivet in the slot.

DESCRIPTION OF THE PREFERRED EMBODIMENT

Figures 1, 2:
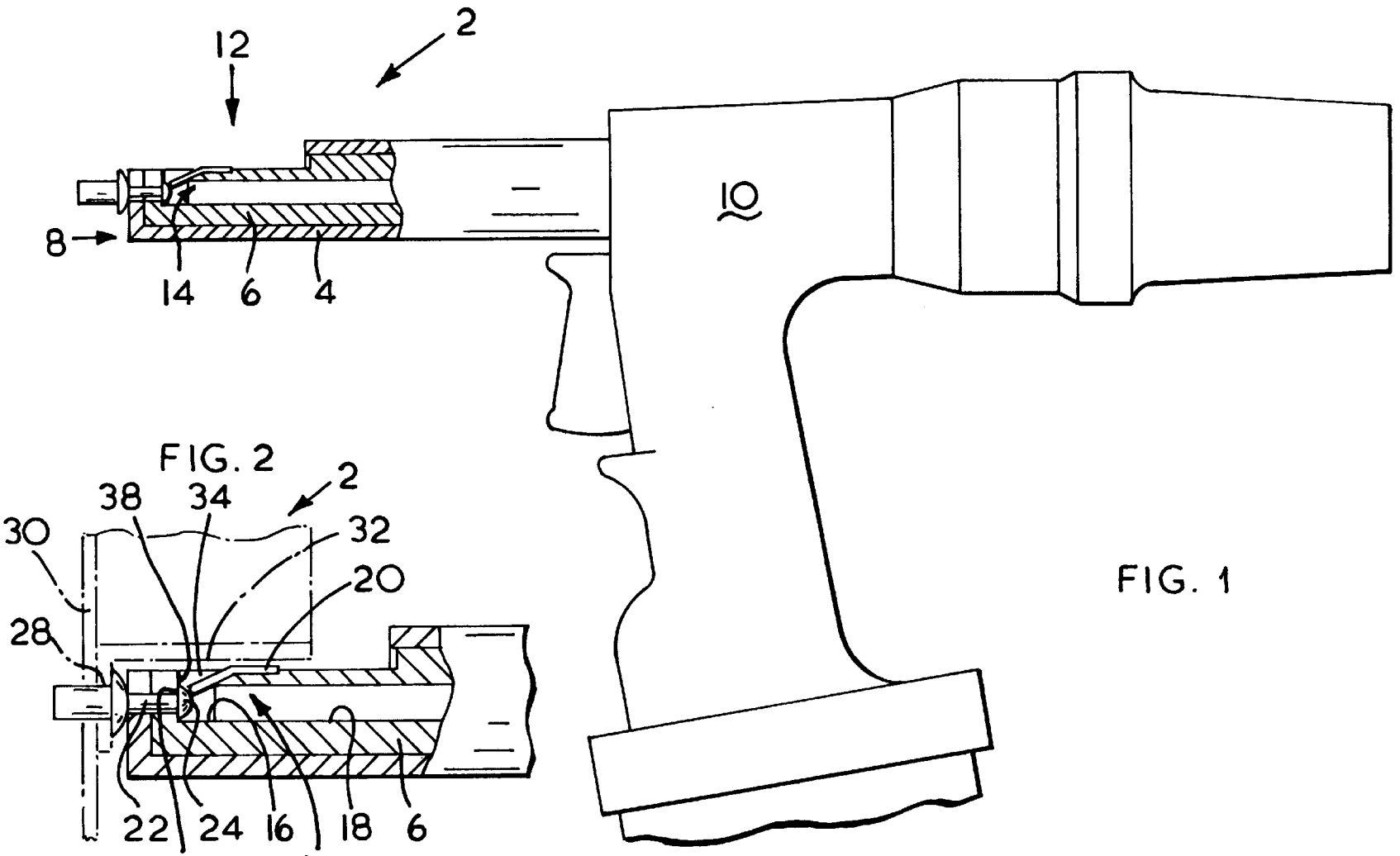
FIG. 1 is a view, partially cut away, of an embodiment of a blind rivet setting tool.
FIG. 2 is a view of part of the tool of FIG. 1 with a rivet in place in the setting tool.

As can be seen from FIGS. 1 and 2, a blind rivet setting tool (10) includes a front end (2) comprising an outer support barrel (4), an inner pulling mandrel (6) and a rivet flange contacting face (8). Extending from the rivet flange contacting face (8), a portion of the barrel (4) and a portion of the pulling mandrel (6) have been cut away to expose a cut-away face (12). A slot (14) comprising a first section (16), a second section (18) and a third section (34) extends along the barrel (4) and pulling mandrel (6). A retaining spring (20) is mounted at the end of the third section (34) of the slot (14).

FIG. 2 shows the front end (2) of the blind rivet setting tool (10) with a blind rivet assembly (22) in place. The head (24) of the mandrel of the rivet assembly (22) is located in the third section (34) of the slot (14) such that the inner face (36) of the pulling head of the rivet (22) abuts the inner face (38) of the section (34) and is held in place by the retaining spring (20).

Figure 3:
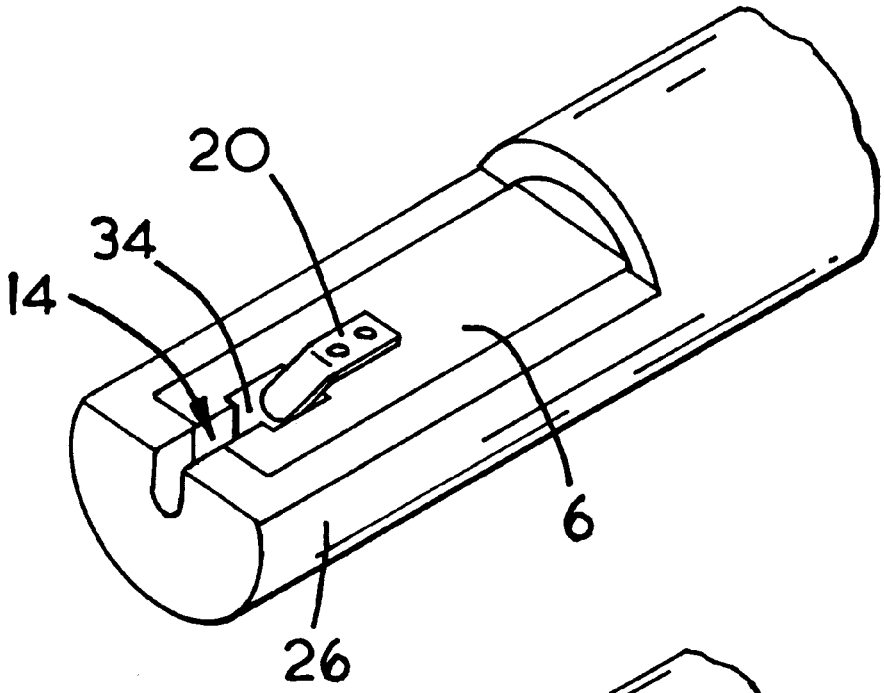
FIG. 3 is a perspective view of the front end of the blind rivet setting tool of FIG. 1, to an enlarged scale, ready to accept a rivet.
Figure 4:
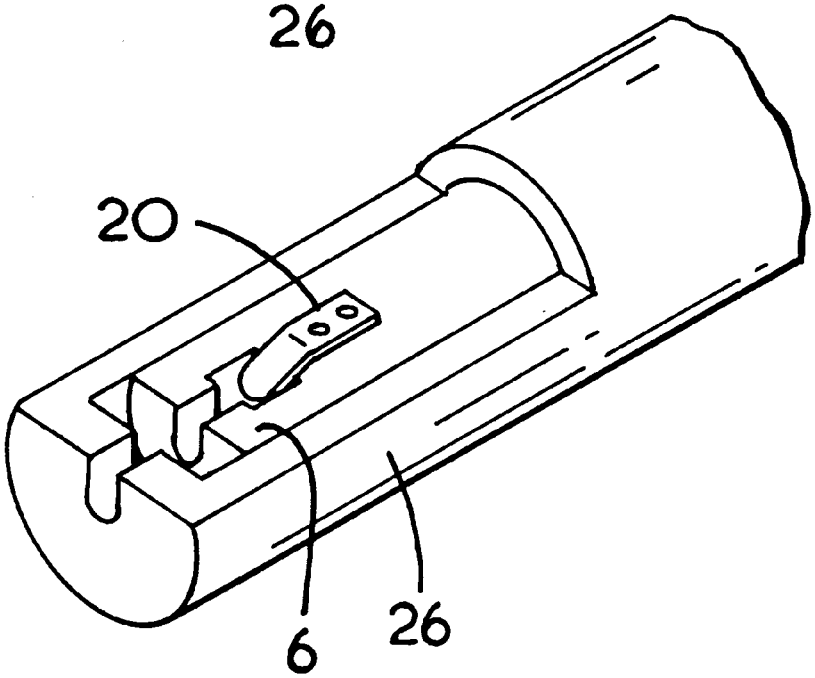
FIG. 4 is a similar view to that of FIG. 3, after setting of the rivet.

The portion (26) of the barrel (4) and pulling mandrel (6) which remains after the portion has been cut away is, as can be seen from FIG. 3, designed so that the cut-away face (12) is located at approximately half the flange diameter of the rivet, from the center line of the barrel (4) and pulling mandrel (6).

The rivet assembly is set in conventional manner, but, as can be seen from FIG. 2, the cut-away design of the front end (2) allows access to a hole (28) in a workpiece (30) even though a face (32) is located very close to the hole (28).

As the setting sequence commences, the inner pulling mandrel (6) of the tool (10) is pulled backwards by means of the pulling piston (not shown) in the setting tool and the rivet is set by supporting the flange of the rivet body by the outer barrel (4).

The spent mandrel is ejected through a hole (not shown) in the inner pulling mandrel (6) to a collection bottle mounted rearward of the setting tool.

What is claimed is:

1. A blind rivet setting tool (10) comprising a front end (2) including an outer support barrel (4), an inner pulling mandrel (6), and a rivet flange contacting face (8), characterized in that a portion of the outer support barrel (4) and a portion of the inner mandrel (6) are cut away along the length of the tool (10) extending from the rivet flange contacting face (8) to provide a cut-away face (12), a slot (14) extending from the rivet flange contacting face (8) of the outer support barrel (4) along the length of the barrel (4) and pulling mandrel (6), said slot being open to the cut away face (12) of the barrel (4) and pulling mandrel (6), and comprising a first section (16) located in the outer support barrel (4) and sized to accept the mandrel of a blind rivet, a second section (18) located in the pulling mandrel (6) and sized to accept the mandrel of a blind rivet, and a third section (34) located in the pulling mandrel (6) and sized to accept the pulling head of the mandrel of the blind rivet, and a retaining member (20) extending into said slot (14) and abutting a rivet positioned in said slot to prevent inadvertent removal of the rivet from the slot.

2. A setting tool as claimed in claim 1 wherein said retaining member (20) comprises a spring extending into said third section (34) of said slot, said spring being flexible inwardly to permit introduction of a rivet into said slot while resisting removal thereof from said slot.

* * * * *